US008226436B2

(12) United States Patent
Suzuki

(10) Patent No.: US 8,226,436 B2
(45) Date of Patent: Jul. 24, 2012

(54) TERMINAL FITTING AND CONNECTOR PROVIDED THEREWITH

(75) Inventor: Masakazu Suzuki, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/017,073

(22) Filed: Jan. 31, 2011

(65) Prior Publication Data

US 2011/0189899 A1 Aug. 4, 2011

(30) Foreign Application Priority Data

Feb. 2, 2010 (JP) ..... 2010-021593

(51) Int. Cl.
*H01R 13/40* (2006.01)

(52) U.S. Cl. ..... 439/595

(58) Field of Classification Search ..... 439/595
See application file for complete search history.

(56) References Cited

U.S. PATENT DOCUMENTS

| | | | | |
|---|---|---|---|---|
| 5,630,733 | A | 5/1997 | Jinno et al. | |
| 6,179,671 | B1 | 1/2001 | Ohsumi | |
| 6,869,312 | B2 * | 3/2005 | Hasebe | 439/595 |
| 2003/0008557 | A1 | 1/2003 | Suzuki | |
| 2007/0105457 | A1 | 5/2007 | Machida et al. | |
| 2010/0105229 | A1 | 4/2010 | Ohsaka | |

FOREIGN PATENT DOCUMENTS

| | | | |
|---|---|---|---|
| EP | 1303008 | A2 | 4/2003 |
| JP | 2009-252558 | | 10/2009 |

* cited by examiner

*Primary Examiner* — Phuong Dinh
(74) *Attorney, Agent, or Firm* — Gerald E. Hespos; Michael J. Porco

(57) ABSTRACT

A terminal fitting (30) includes a main portion (31) substantially in the form of a rectangular tube formed with a locking hole (42) open in an outer surface. The terminal fitting (30) is inserted into a cavity (12) formed in a housing 10 made of synthetic resin and retained by engaging the locking hole (42) with a locking lance (13) in the form of a cantilever extending along an inner wall of the cavity (12). Restrictions (44) are formed in the main portion (31) and contact the locking lance (13) to prevent any further entering movement of the locking lance (13) when the locking lance (13) enters the main portion (31) in an undesirable manner.

13 Claims, 11 Drawing Sheets

TERMINAL FITTING AND CONNECTOR PROVIDED THEREWITH

BACKGROUND OF THE INVENTION

1. Field of the Invention

This invention relates to a terminal fitting and connector.

2. Description of the Related Art

Japanese Unexamined Patent Publication No. 2009-252558 discloses a connector with a housing formed with cavities and terminal fittings that are inserted into the cavities. The terminal fitting has a rectangular tubular main portion and a rectangular locking hole is formed in a wall of the main portion. Locking lances are cantilevered along inner walls of the cavities. Each locking lance has a locking projection that engages the locking hole in the terminal fitting to retain the terminal fitting that has been inserted properly into the cavity.

The demand for miniaturization of connectors has increased significantly in recent years. However, a miniaturized connector has smaller less rigid locking lances. An external force may act on a terminal fitting in a withdrawing direction and may cause the less rigid locking lance to deform into the main body of the terminal fitting. A locking lance that has been deformed plastically in this manner can no longer exhibit its original function.

The invention was developed in view of the above, and an object thereof is to prevent a locking lance from being deformed into a main body of a terminal fitting.

SUMMARY OF THE INVENTION

The invention relates to a terminal fitting with a substantially rectangular tubular main portion and a locking hole open in an outer surface of the main portion. The terminal fitting is part of a connector that has a housing formed with a cavity configured to receive the terminal fitting. The housing has a locking lance that projects into the cavity and engages in the locking hole to retain the terminal fitting in the cavity. At least one restriction is formed in the main portion and contacts the locking lance to prevent the locking lance from entering the main portion in an undesirable manner.

The restriction limits entry of the locking lance into the main portion when the locking lance is being deformed undesirably due to external forces on the terminal fitting. Thus, there is no likelihood that the locking lance will be deformed plastically beyond its resiliency limit. Therefore, the locking lance is prevented from being pulled excessively into the main portion of the terminal fitting.

The restriction is formed by hammering part of a wall of the main portion to project. Thus, the restriction is connected to the wall at a plurality of positions and is stronger than a restriction that is supported only at one end.

The at least one restriction may comprise first and second restrictions that are spaced apart in a width direction that intersects both an intersecting direction of the terminal and a resiliently deforming direction of the locking lance.

The laterally spaced restrictions stabilize the posture of the locking lance when the locking lance contacts the restrictions, thereby preventing an undesirable deformation of the locking lance.

A restriction could be formed by cutting a wall of the main portion. However, an edge of such a restriction that faces a locking lance could damage the locking lance when the restriction and the locking lance come into contact. Accordingly, the area of the restriction facing the locking lance preferably is formed by bending a wall of the main portion.

Thus, there is no likelihood that the locking lance will be damaged by contact with the restriction.

The restriction preferably is narrow and long in forward and backward directions and/or has a cross-sectional shape cut along a plane perpendicular to forward and backward directions and is bent substantially in L-shape.

The locking hole preferably is formed over the entire width of a wall of the main portion while also cutting distal end edges of adjacent lateral walls.

The invention also relates to a connector with a housing made of synthetic resin and at least one cavity for receiving the above-described terminal fitting. A locking lance is cantilevered to extend along the cavity and engages in the locking hole of the above-described terminal fitting to retain the terminal fitting in the cavity of the housing. The locking lance preferably is slightly narrower than the terminal fitting.

A front holder preferably is to be assembled into or onto the housing after the terminal fitting is inserted properly into the cavity and may define part of the cavity.

An inner surface of the front holder preferably is recessed to form at least one terminal insertion space substantially corresponding to the respective cavity. The terminal insertion space fits on the terminal fitting when the front holder is assembled with the housing.

The front holder preferably contacts the locking lance and prevents the locking lance from being resiliently deformed toward a retracted position.

A retainer preferably is assembled into the housing and engages the terminal fitting to retain the terminal fitting in the cavity.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
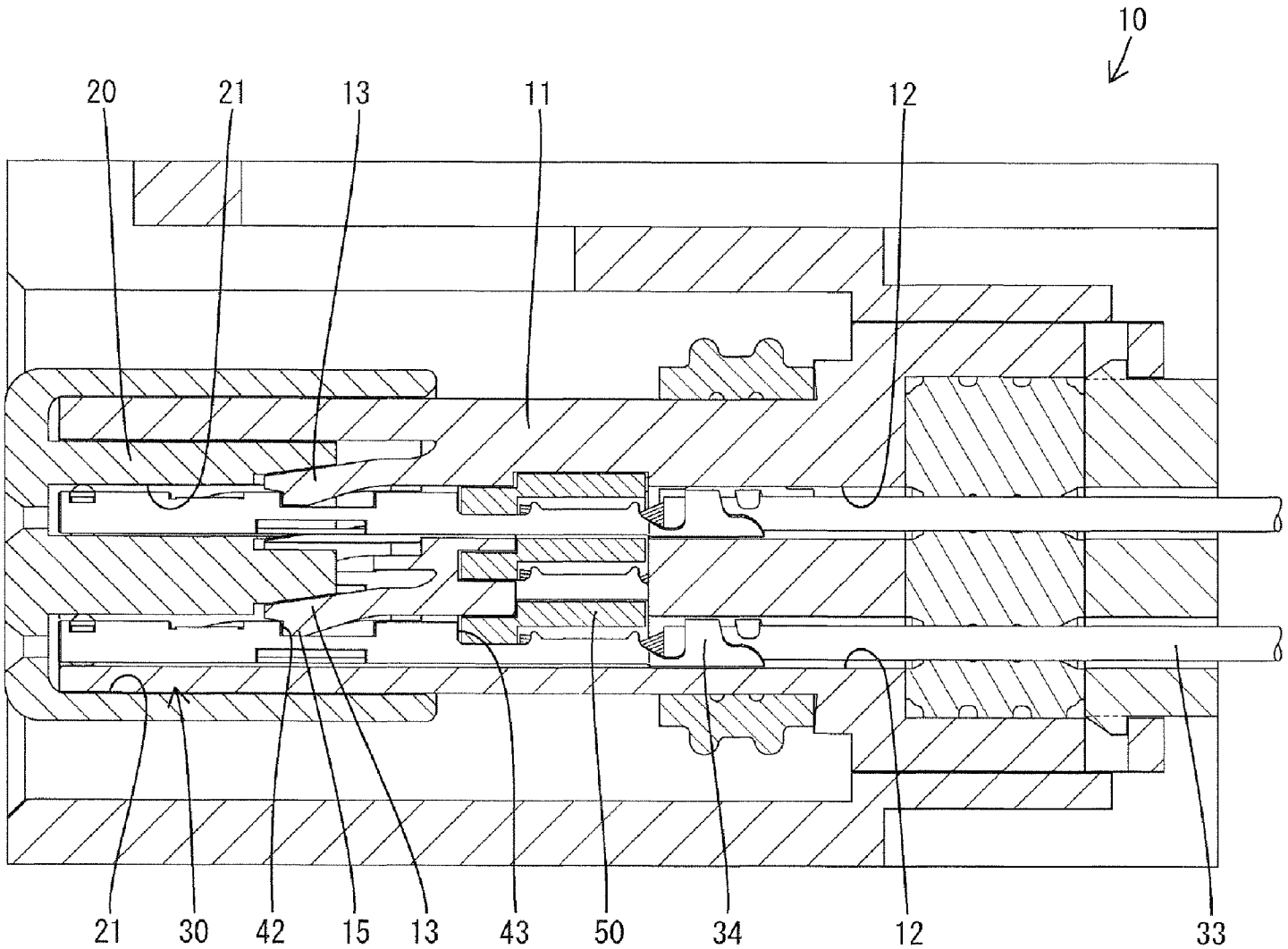
FIG. 1 is a section of a connector in accordance with the invention.
Figure 2:
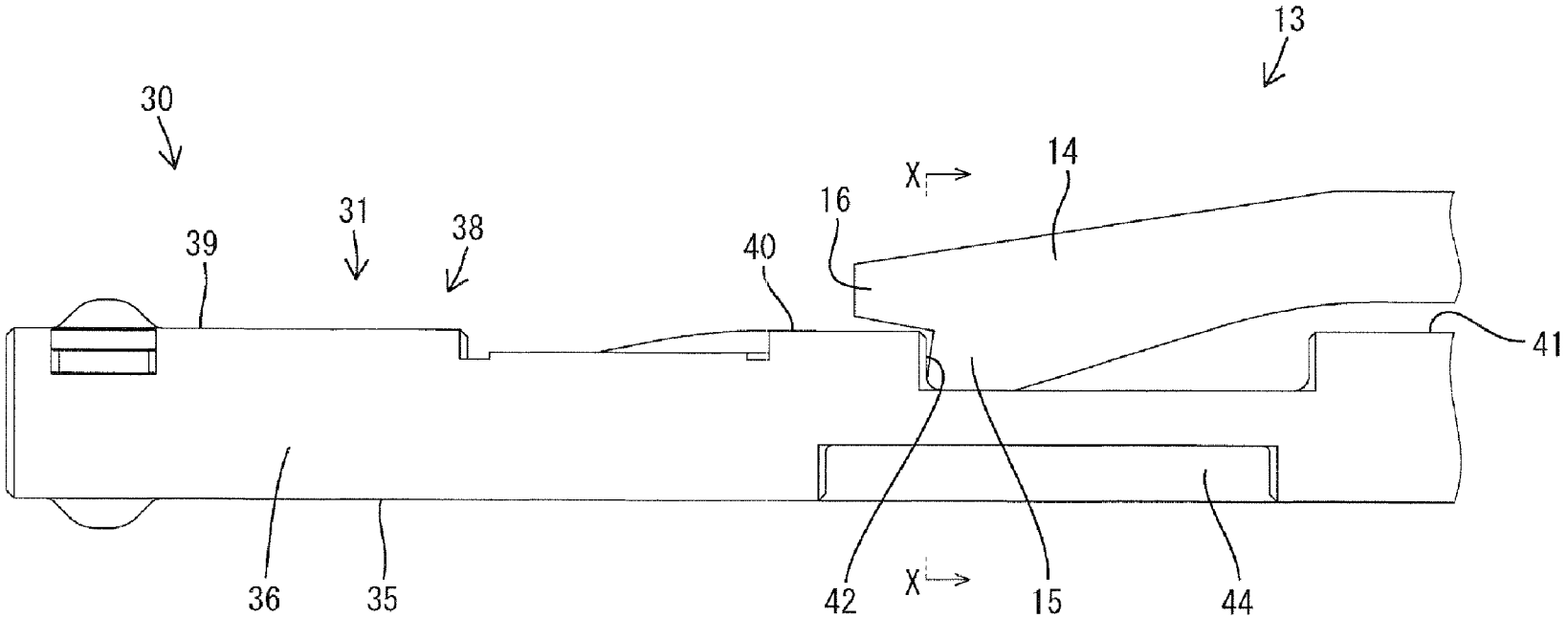
FIG. 2 is a partial enlarged side view showing a locked state of a terminal fitting and a locking lance.
Figure 3:
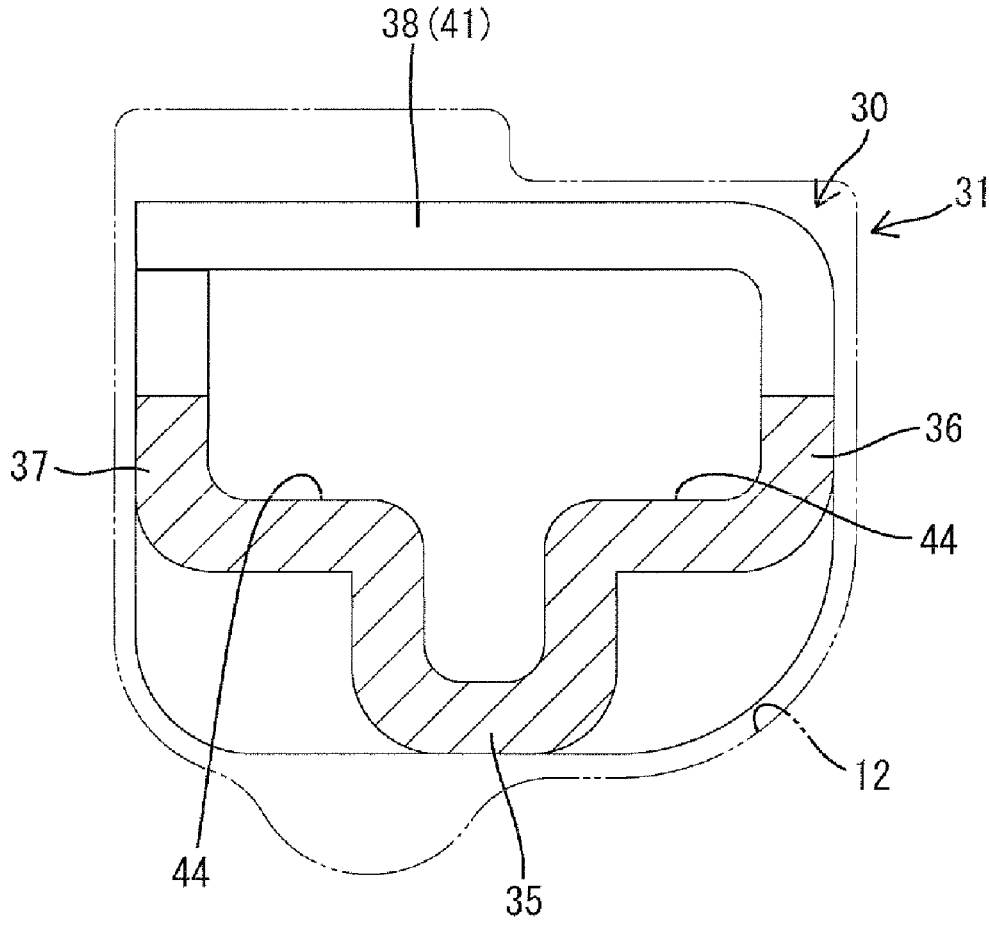
FIG. 3 is a section along X-X of FIG. 2 without the locking lance.
Figure 4:
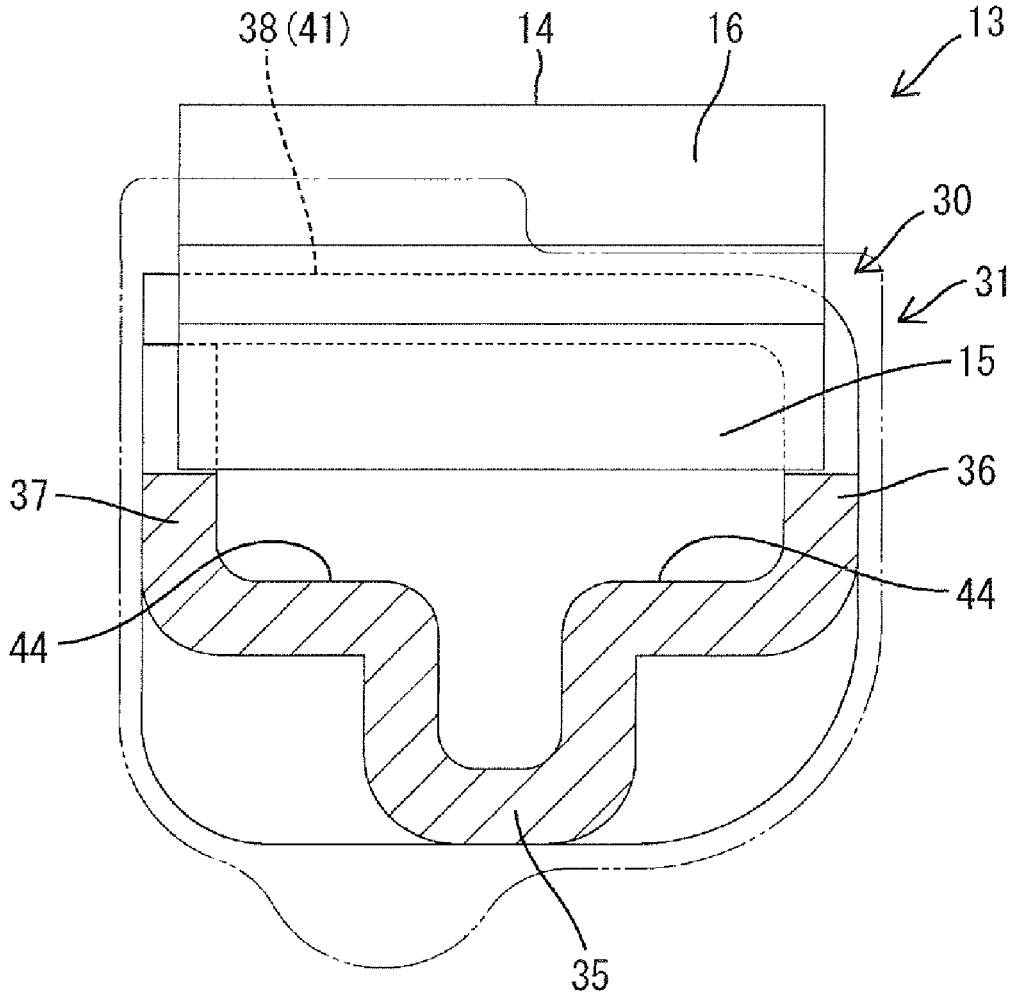
FIG. 4 is a section along X-X of FIG. 2 with the locking lance.

A connector in accordance with the invention has a housing 10 made e.g. of synthetic resin. The housing 10 includes a main body 11 and cavities 12 penetrate through the main body 11 in forward and backward directions. A front holder 20 is mounted on a front end of the main body 11 and forms part of front ends of the cavities 12. Terminal fittings 30 are inserted into the respective cavities 12 from behind (from right in FIG. 1).

A locking lance 13 is cantilevered forward along a ceiling surface (upper inner wall in FIG. 1) in each cavity 12 slightly behind the front end thereof. The locking lance 13 normally is at a locking position (see FIG. 1) where it can lock the terminal fitting 30 in the cavity. However, the locking lance 13 is resiliently deformable towards a retracted position (not shown) more outward than the locking position.

Each locking lance 13 has a lance main body 14 in the form of a plate aligned substantially parallel to the ceiling wall and a lock 15 projecting from a surface of the lance main body 14 facing the insertion path of the terminal fitting 30. The lock 15 locks the terminal fitting 30 that has been inserted to a proper position in the cavity 12, thereby retaining the terminal fitting 30 in the cavity 12. The front end of the lock 15 is slightly forward of the front end of the lance main body 14, and an area of the lance main body 14 before the lock 15 functions as a jig contact portion 16. A jig (not shown) can be brought into contact with the jig contact portion 16 from below for resiliently deforming the locking lance 13 from the locking position toward the retracted position.

The entire locking lance 13, including the lance main body 14 and the lock 15, is slightly narrower than the terminal fitting 30. The lance main body 14 is above the ceiling wall and the lock 15 is at least partly in the insertion path when the locking lance 13 is in the locking position to lock the terminal fitting 30 in the cavity 12. The lock 15 is retracted laterally from the insertion path for the terminal fitting 30 when the locking lance 13 is at the retracted position.

The front holder 20 is assembled to the housing main body 11 from the front after the terminal fittings 30 are inserted properly into the cavities 12. The rear surface of the front holder 20 is recessed to form terminal insertion spaces 21 corresponding to the respective cavities 12. The terminal insertion spaces 21 are fit on the front ends of the corresponding terminal fittings 30 when the front holder 20 is assembled to the housing main body 11 so that the front ends of the terminal fittings 30 are accommodated at least partly in the corresponding terminal insertion spaces 21. The front holder 20 stabilizes the terminal fittings 30 in the cavities 12. Further, the front holder 20 contacts surfaces of the locking lances 13 vertically opposite to the locks 15, thereby preventing the locking lances 13 from being resiliently deformed toward the retracted position.

Each terminal fitting 30 is a female terminal that is long and narrow in forward and backward directions. A rectangular tubular main portion 31 is formed at a front end of the terminal fitting 30 and a resilient contact piece 32 is defined therein. A wire connecting portion 34 is formed at the rear part of the terminal fitting 30 and forms at least one open barrel that can be crimped into connection with a wire 33.

The rectangular tubular main portion 31 has a plurality of connected walls bent along fold lines extending substantially in forward and backward directions. The walls include a bottom wall 35, left and right side walls 36, 37 projecting from up at substantially right angles from the left and right sides of the bottom wall 35, and an upper wall 38 divided into front, middle and rear parts. More particularly, the upper wall 38 is composed of a front panel 39 extending at a substantially right angle from a front end portion of an upper end of the left wall 36, a middle panel 40 extending at a substantially right angle from a position on an upper end of the left wall 36 behind the front wall 39, and a rear panel 41 extending at a substantially right angle from a rear end portion of the left wall 36.

A locking hole 42 is defined between the middle panel 40 and the rear panel 41 in an upper surface of the main portion 31 and is exposed to the outside of the main portion 31. The locking hole 42 is formed over the entire width of the upper surface of the main portion 31 between upper end ends of the left and right and left walls 36, 37. The lock 15 of the locking lance 13 formed along the inner wall of the cavity 12 enters the main portion 31 and engages the locking hole 42 from a withdrawing direction so that the terminal fitting 30 is prevented from being withdrawn from the cavity 12.

A locking edge 43 is defined at the rear end of the rear panel 41 of the upper wall 38 of the main portion 31 facing an upward or outward opening of a coupling between the main portion 31 and the wire connecting portion 34. A retainer 50 is assembled into the housing 10 after the terminal fittings 30 are inserted in the cavities 12 and engages the locking edge 43 to retain the terminal fittings 30. Thus, each terminal fitting 30 is locked doubly by the respective locking lance 13 and the retainer 50.

A strong backward pulling force on the terminal fitting 30 retained by the locking lance 13 has the potential of deforming the locking lance 13 in an undesirable manner that urges the lance main body 14 into the main portion 31. In this case, at least one of the opposite outer lateral surfaces of the locking lance 13 may be scraped slightly by upper end edges of the opposite side walls 36, 37 of the terminal fitting 30. The jig contact portion 16 is caught by the rear end edge of the middle panel 40 of the upper wall 38. Thus, the locking lance 13 may curve. If a degree of curved deformation exceeds a resiliency limit of the locking lance 13, the locking lance 13 is deformed plastically or destroyed and cannot be reused.

As a countermeasure against this, the terminal fitting 30 is formed with two lateral restrictions 44 spaced apart in a width direction that intersects both an inserting direction of the terminal fitting 30 and a resiliently deforming direction of the locking lance 13. The restrictions prevent the lock 15 and the lance main body 14 from being deformed excessively in an undesirable manner to enter the main portion 31 in a state when the locking lance 13 is at the locking position.

The restrictions 44 are formed by bending (i.e. partially hammering) left and right sides of the bottom wall 35 and lower portions of the left and right walls 36, 37 at angles and preferably at substantially right angles to project into the main portion 31. The restrictions 44 are long and narrow in forward and backward directions and define substantially L-shaped when viewed in a cross-section taken along a plane perpendicular to forward and backward directions.

Each terminal fitting 30 is inserted into the cavity 12 from behind. As a result, the upper surface of the main portion 31 interferes with the lock 15 and causes the locking lance 13 to deform resiliently in a direction intersecting the insertion direction and toward the retracted position. The locking lance 13 resiliently returns to the locking position when the terminal fitting 30 reaches a proper insertion position so that the lock 15 is engaged in the locking hole 42 and retains the terminal fitting 30.

Figure 5:
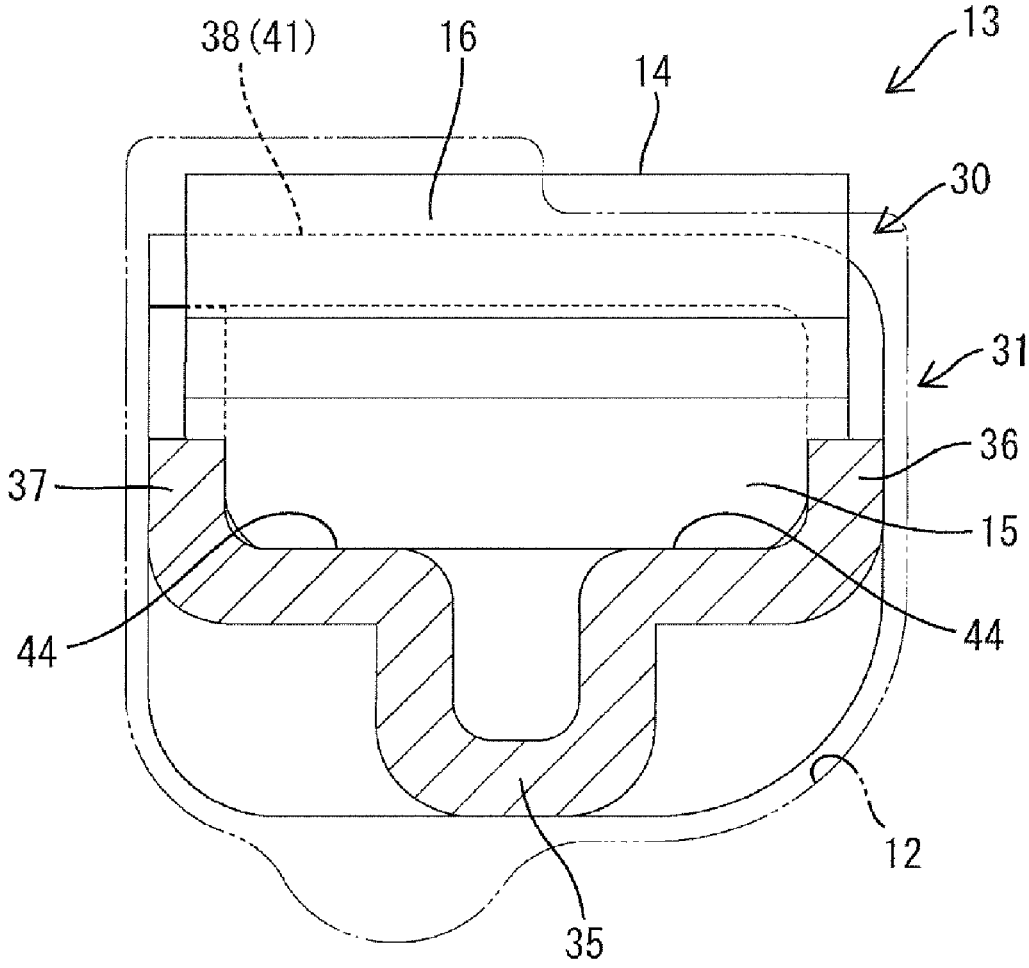
FIG. 5 is a section showing a state where undesirable entrance of the locking lance into a main body of the terminal fitting is prevented.
Figure 6:
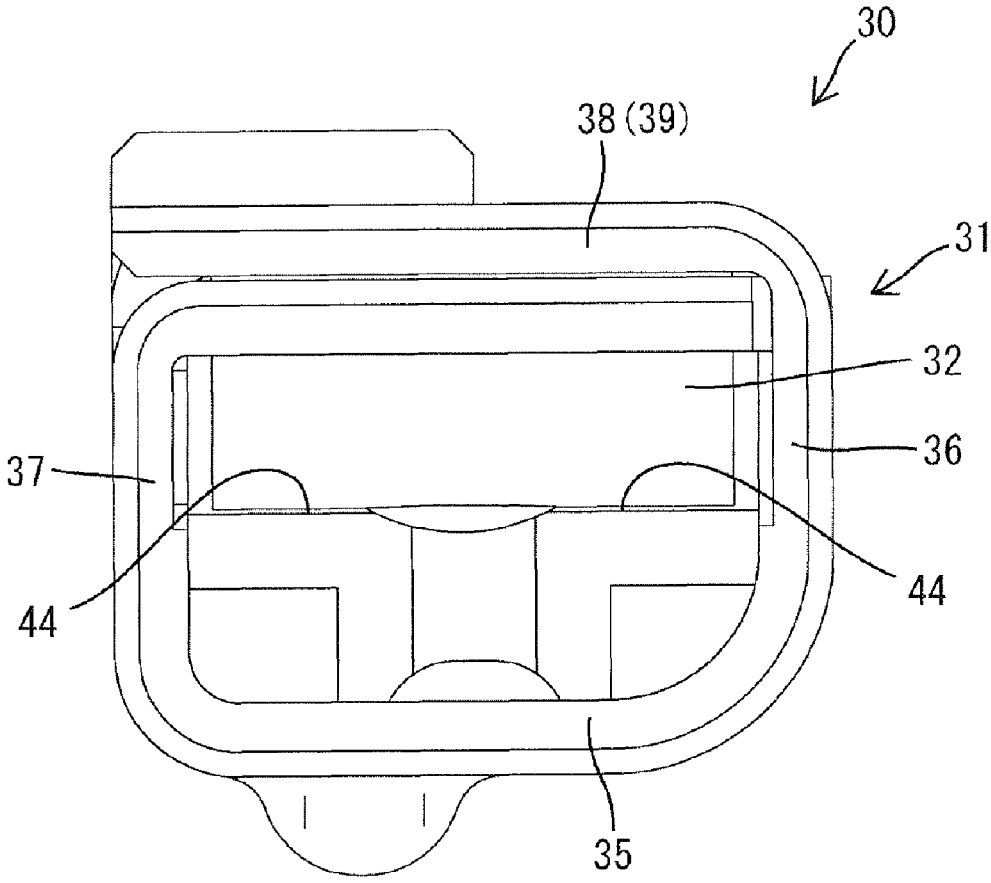
FIG. 6 is a front view of the terminal fitting.
Figure 7:
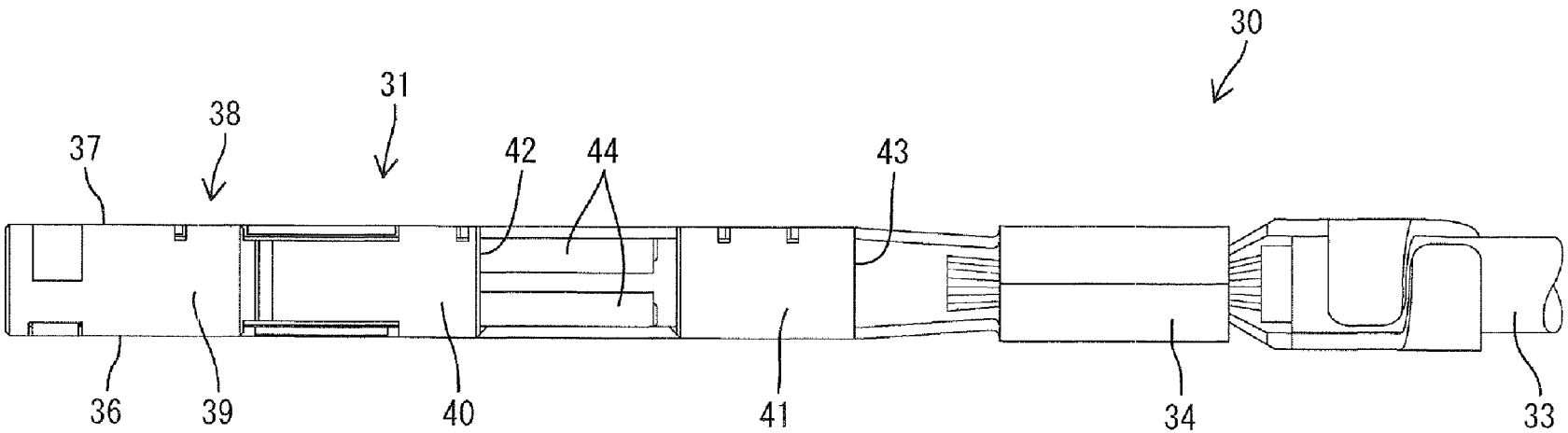
FIG. 7 is a plan view of the terminal fitting.
Figure 8:
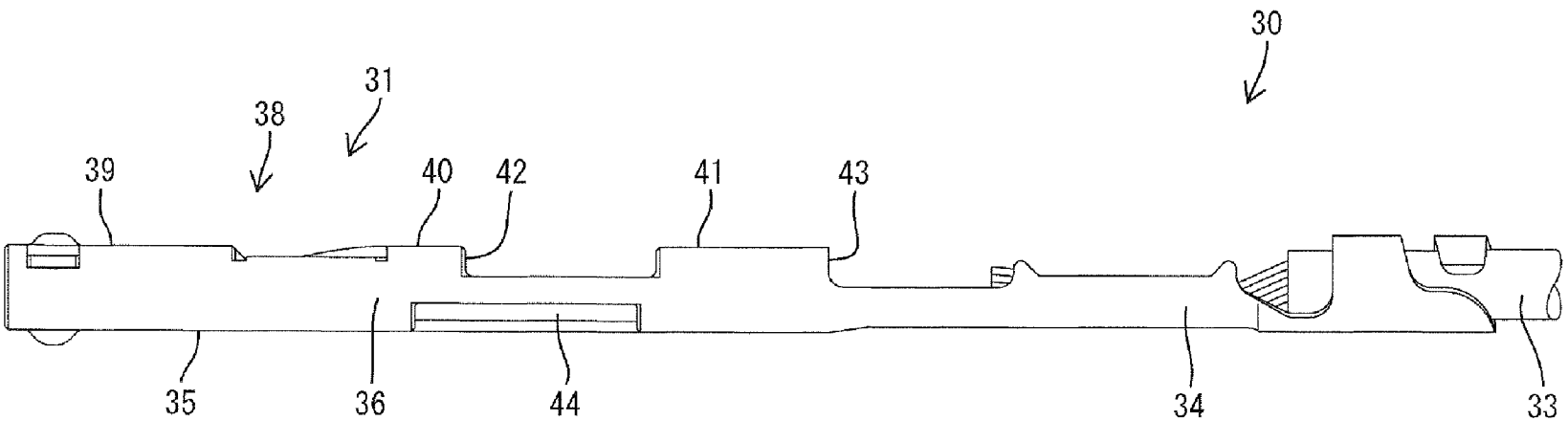
FIG. 8 is a side view of the terminal fitting.
Figure 9:
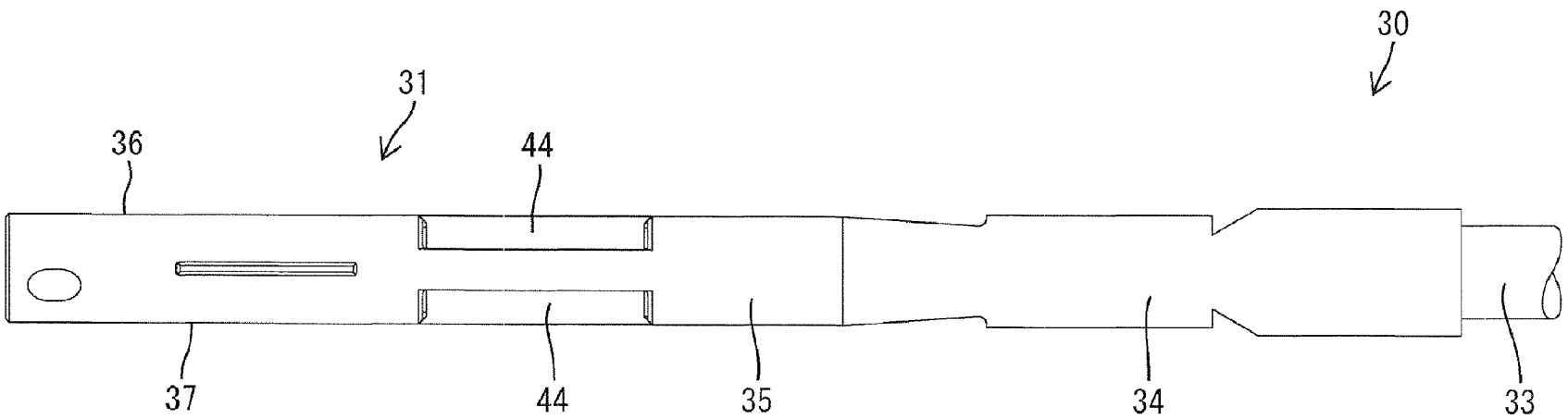
FIG. 9 is a bottom view of the terminal fitting.
Figure 10:
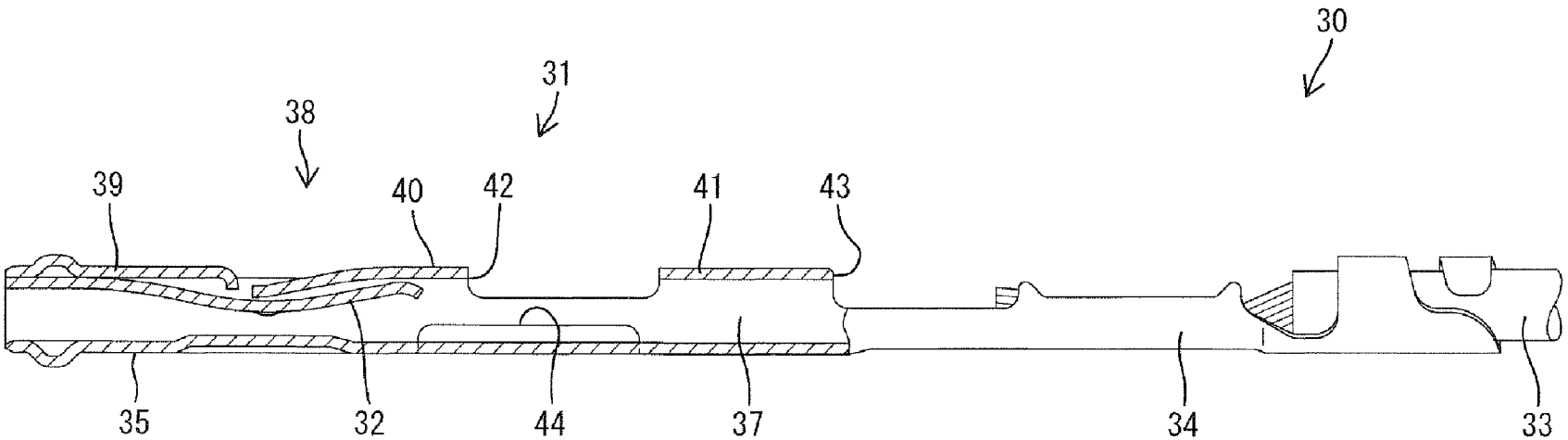
FIG. 10 is a section of the terminal fitting.
Figure 11:
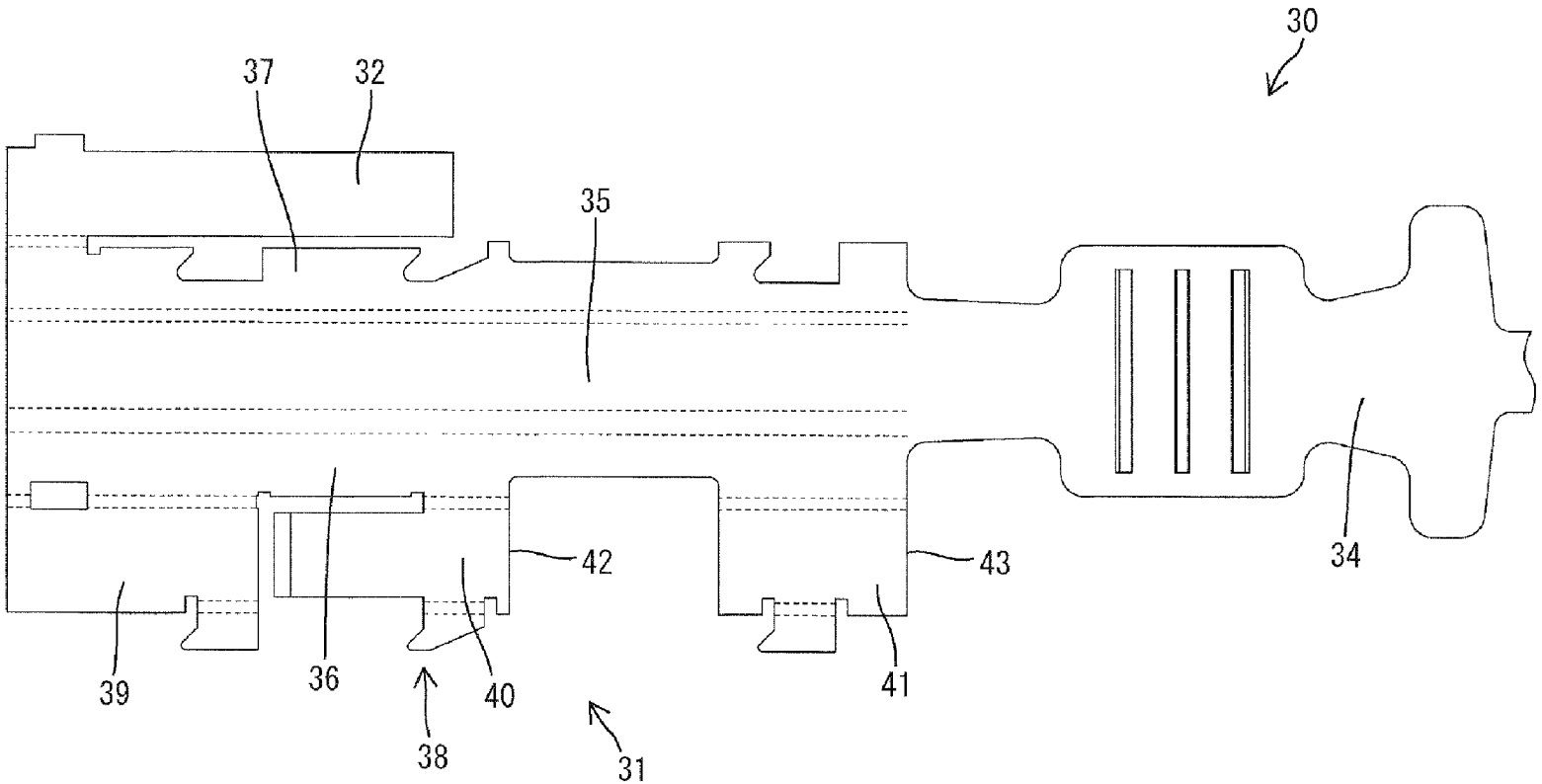
FIG. 11 is a development view of the terminal fitting.

A strong backward pulling force could be exerted on the terminal fitting 30 that is retained by the locking lance 13. As a result, the locking lance 13 is urged into the main portion 31. However, the restrictions 44 engage the locking lance 13, as shown in FIG. 5, to prevent any further undesirable pulling movement of the locking lance 13 into the main portion 31. As a result, the locking lance 13 is not deformed plastically or destroyed.

The restrictions 44 preferably are formed by partially hammering the bottom wall 35 and the left and right walls 36, 37. Thus, the restrictions 44 are connected to the main portion 31 at both the bottom wall 35 and the left and right walls 36, 37. Therefore, the restrictions 44 are stronger than structures supported only at one end.

The two restrictions 44 are spaced apart in the width direction, which intersects both the inserting direction of the terminal fitting 30 and the resilient deforming direction of the locking lance 13. Thus, the posture of the locking lance 13 is stabilized when the locking lance 13 contact with the restrictions 44. Therefore, inclination of the locking lance 13 in directions intersecting the insertion direction is prevented and undesirable deformation of the locking lance 13 due to inclination to left or right will not occur.

The locking lance could be damaged by contact with the restrictions if areas of restrictions facing the locking lance were cut surfaces of walls or edges formed by cutting. However, areas of the restrictions 44 facing the locking lance 13 are formed by bending or hammering the bottom wall 35 and the left and/or right walls 36, 37, thereby reducing the likelihood of damage to the locking lance 13 caused by contact with the restrictions 44.

The invention is not limited to the above described and illustrated embodiment. For example, the following embodiments are also included in the technical scope of the present invention.

Although the restriction is formed by hammering the walls in the above embodiment, it may be formed by cutting and bending the wall. The restriction may be connected to the main portion at only one of the bottom walls or the left and right walls. In such an embodiment, the restriction is connected to the main body at only one position.

Two restrictions are spaced apart in the width direction in the above embodiment, but only one restricting portion may be provided.

Areas of the restrictions facing the locking lance are formed by bending the walls of the main portion in the above embodiment. However, they may be cutting surfaces of the walls of the main portion or edge portions formed by cutting.

The above-described terminal fitting is a female terminal fitting with a rectangular or polygonal tubular main portion formed to receive a tab. However, the present invention may also be applied to a male terminal fitting including a tab to be at least partly inserted into a main portion of a female terminal fitting. In this case, a main portion (particularly substantially in the form of a rectangular or polygonal tube) may be provided to be continuous with the rear end of the tab and an escaping portion may be formed in this main portion.

What is claimed is:

1. A terminal fitting, comprising: a substantially tubular main portion formed with a locking hole open in an outer surface of the tubular main portion for receiving a locking lance so that the locking lance can engage the tubular main portion and at least one restriction projecting into the tubular main portion at a position opposed to the locking hole for limiting insertion of the locking lance into the locking hole, the restriction being long and narrow along an axial direction of the tubular main portion and having a substantially L-shape in a cross section perpendicular to the axial direction of the tubular main portion.

2. The terminal fitting of claim 1, wherein the restriction is formed by hammering at least one wall of the main portion so that all peripheral regions of the restriction are unitary with the walls of the main portion.

3. The terminal fitting of claim 2, wherein the at least one restriction comprises two restrictions spaced apart in a width direction intersecting an axial direction of the tubular main portion.

4. The terminal fitting of claim 1, wherein an area of the restriction facing the locking hole is formed by bending a wall of the main portion.

5. The terminal fitting of claim 1, wherein the locking hole is formed over an entire width of a wall of the main portion while cutting also distal end edges of adjacent lateral walls.

6. A connector comprising:

a housing made of synthetic resin, at least one cavity formed in the cavity and a locking lance provided in the cavity; and at least one terminal fitting having a substantially tubular main portion insertable into the cavity, the main portion being formed with a locking hole engageable by the locking lance for retaining the terminal fitting in the cavity, at least one restriction formed in the main portion and facing the locking hole, the restriction being long and narrow along an axial direction of the tubular main portion and having a substantially L-shape in a cross section perpendicular to the axial direction of the tubular main portion for limiting movement of the locking lance into the main portion.

7. The connector of claim 6, wherein the locking lance is slightly narrower than the terminal fitting.

8. The connector of claim 6, further comprising a front holder be assembled onto the main body to define part of the cavity.

9. The connector of claim 8, wherein an inner surface of the front holder is recessed to form at least one terminal insertion space substantially corresponding to the respective cavity, the terminal insertion space being fit on the terminal fitting when the front holder is assembled with the main body.

10. The connector of claim 8, wherein the front holder contacts the locking lance to prevent the locking lance from being deformed toward a retracted position.

11. A connector of claim 10, further comprising a retainer assembled into the housing and engageable with the terminal fitting to retain the terminal fitting in the cavity.

12. The connector of claim 6, wherein the restriction is formed by hammering at least one wall of the main portion so that all peripheral regions of the restriction are unitary with the walls of the main portion.

13. The connector of claim 6, wherein the at least one restriction comprises two restrictions spaced apart in a width direction intersecting an axial direction of the tubular cavity.

* * * * *